US007293735B1

(12) United States Patent
Neumann et al.

(10) Patent No.: US 7,293,735 B1
(45) Date of Patent: Nov. 13, 2007

(54) ROLL STORAGE SYSTEM FOR GUIDING SHEET MEMBERS

(75) Inventors: Ulrich Neumann, Lippstadt (DE); Manfred Krafft, Salzkotten (DE); Klaus Tauchert, Villingen-Schwenningen (DE)

(73) Assignee: Siemens Nixdorf Informationssysteme AG (DE)

( * ) Notice: Subject to any disclaimer, the term of this patent is extended or adjusted under 35 U.S.C. 154(b) by 0 days.

(21) Appl. No.: 09/463,495

(22) PCT Filed: Jul. 3, 1998

(86) PCT No.: PCT/DE98/01856

§ 371 (c)(1),
(2), (4) Date: Jan. 25, 2000

(87) PCT Pub. No.: WO99/05652

PCT Pub. Date: Feb. 4, 1999

(30) Foreign Application Priority Data

Jul. 25, 1997 (DE) ..... 197 32 129

(51) Int. Cl.
*B65H 39/14* (2006.01)

(52) U.S. Cl. ..... 242/528; 242/547; 242/541.4

(58) Field of Classification Search ..... 209/534; 242/528, 547, 540, 541, 541.3, 541.4, 541.5; 226/170, 171, 172; 271/216
See application file for complete search history.

(56) References Cited

U.S. PATENT DOCUMENTS

| | | | | |
|---|---|---|---|---|
| 4,337,864 | A * | 7/1982 | McLean | 209/534 |
| 4,434,948 | A * | 3/1984 | Feldkamper | 242/528 |
| 4,528,794 | A * | 7/1985 | Thierstein | 53/118 |
| 4,651,941 | A * | 3/1987 | Muller | 242/528 |
| 5,064,074 | A * | 11/1991 | Edin et al. | 209/534 |
| 5,116,043 | A * | 5/1992 | Jermann et al. | 271/213 |
| 5,533,627 | A * | 7/1996 | Nordqvist | 209/534 |
| 6,193,227 | B1 * | 2/2001 | Boss | 270/52.12 |

* cited by examiner

*Primary Examiner*—Patrick Mackey
*Assistant Examiner*—Mark Hageman
(74) *Attorney, Agent, or Firm*—Schiff Hardin LLP

(57) ABSTRACT

A roll storage system for guiding a number of sheet members. The roll storage system includes a housing that encloses a supply roll and a storage roll. The supply and storage roll are rotatably mounted for guiding a storage film between them. A guide member is also mounted for guiding each of the number of sheet members into and away from the storage roll.

9 Claims, 3 Drawing Sheets

ROLL STORAGE SYSTEM FOR GUIDING SHEET MEMBERS

BACKGROUND OF THE INVENTION

1. Field of the Invention

The invention relates to a roll storage system for sheet-like objects, in particular banknotes, having a housing, in which a supply roll for a storage film and a storage roll connected to said supply roll are mounted so that they can rotate, and each roll is coupled to a roll drive, the storage film being guided between the supply roll and the storage roll over at least one deflection roller, and having a guide device for guiding sheet-like objects into and out of the coil on the storage roll.

2. Description of the Prior Art

Such a roll storage system is disclosed, for example, by German Patent Document No. 30 42 566 C2. In the solution described there, the guide device is formed by a pair of stationary rollers arranged close to the inlet slot of the housing, the storage film being guided over one of these rollers. The banknotes running in through the inlet slot of the housing thus pass onto the storage film and into the coil on the storage roll. However, guidance of the banknotes running in is only ensured as long as the distance between the roller gap of the stationary pair of rollers and the point at which the storage film runs onto the coil of the storage roll is shorter than the dimension of the banknote in the conveying direction. This requirement limits the difference in diameter of the storage-roll coil which can be used for the storage, and consequently limits the storage capacity of the storage roll.

Guiding the banknotes, which is independent of the abovementioned distance, between the stationary pair of rollers and the point at which the storage film runs onto the storage-roll coil can be achieved by using two storage films, which are led together on the stationary pair of rollers and which enclose the banknotes running in between them. However, this solution, also described in German Patent Document No. 30 42 566 C2, has the disadvantage that two supply rolls are needed, with a corresponding drive mechanism, and that the storage-roll coil becomes thicker as a result of the dual film. Overall, although this means that the entire diameter range of the storage-roll coil can be used for the storage of banknotes, this is achieved at the expense of a relatively high technical outlay.

SUMMARY OF THE INVENTION

The invention is based on the object of specifying a roll storage system of the type mentioned at the beginning which, with a lower overall size and low technical outlay, has a relatively high storage capacity.

According to the invention, this object is achieved in that the guide device includes a conveyor table which can be pivoted about a pivot pin fixed to the housing and can be adjusted parallel to the conveying direction, on which table there is arranged a transfer conveyor for guiding sheet-like objects into the coil and for removing sheet-like objects from the coil on the storage roll.

As a result of the conveyor table being arranged such that it can pivot, its plane can always be set, as the coil diameter changes, in such a way that it is oriented tangentially to the surface of the coil. The change, which occurs with the change in coil diameter, in the distance between an entry point for the sheet-like objects on the housing and the point at which the storage film runs onto the surface of the coil is compensated for by adjusting the conveyor table parallel to the conveying direction. This ensures that the sheet-like objects are guided independently of the current coil diameter, so that a significantly greater part of the coil diameter can be used for the storage of sheet-like objects than was previously used. Trials have shown that, with the solution according to the invention, the storage capacity of the roll storage system operating with a storage film can be increased by 100% over conventional solutions.

The conveyor table is preferably guided by at least one extension in a slot guide fixed to the housing, in such a way that during a pivoting movement it is forcibly displaced parallel to the conveying direction. At the same time, the transfer end of the conveyor table, remote from the pivot pin, is expediently biased so as to rest on the coil on the storage roll, so that the position of the conveyor table is automatically adapted to the coil diameter.

In a preferred embodiment of the invention, the transfer conveyor includes a belt conveyor having an endless belt and supporting and back-pressure rollers interacting therewith. The endless belt is guided over a first roller, mounted coaxially with respect to the pivot pin of the conveyor table, and over a second roller, mounted on the conveyor table. The result of the translational adjustment of the conveyor table relative to the pivot pin is that the length of the endless belt must also change. Although this could, in principle, be counterbalanced by the use of an elastic endless belt, provided the adjustment travel is not very large, it is more expedient for the endless belt of the belt conveyor to be guided over a tensioning device which ensures that the tension, and therefore also the transporting properties of the endless belt, always remain constant.

This solution therefore ensures that the distance between the discharge end of the transfer conveyor and the transfer end of the conveyor table always remains constant, irrespective of the coil diameter of the storage roll and the distance between the entry point of the sheet-like objects on the storage housing and the point at which the storage film runs onto the storage-roll coil.

The second roller of the belt conveyor is preferably arranged coaxially with respect to a deflection roller of the storage film and is fixed so that it rotates with said roller, so that the belt conveyor is driven by the storage film. This dispenses with a dedicated drive for the transfer conveyor and any necessary synchronization of such a drive with the drive of the storage roll.

Further features and advantages of the invention emerge from the following description which, in conjunction with the appended drawings, explains the invention using an exemplary embodiment.

DESCRIPTION OF THE PREFERRED EMBODIMENT

Figure 1:
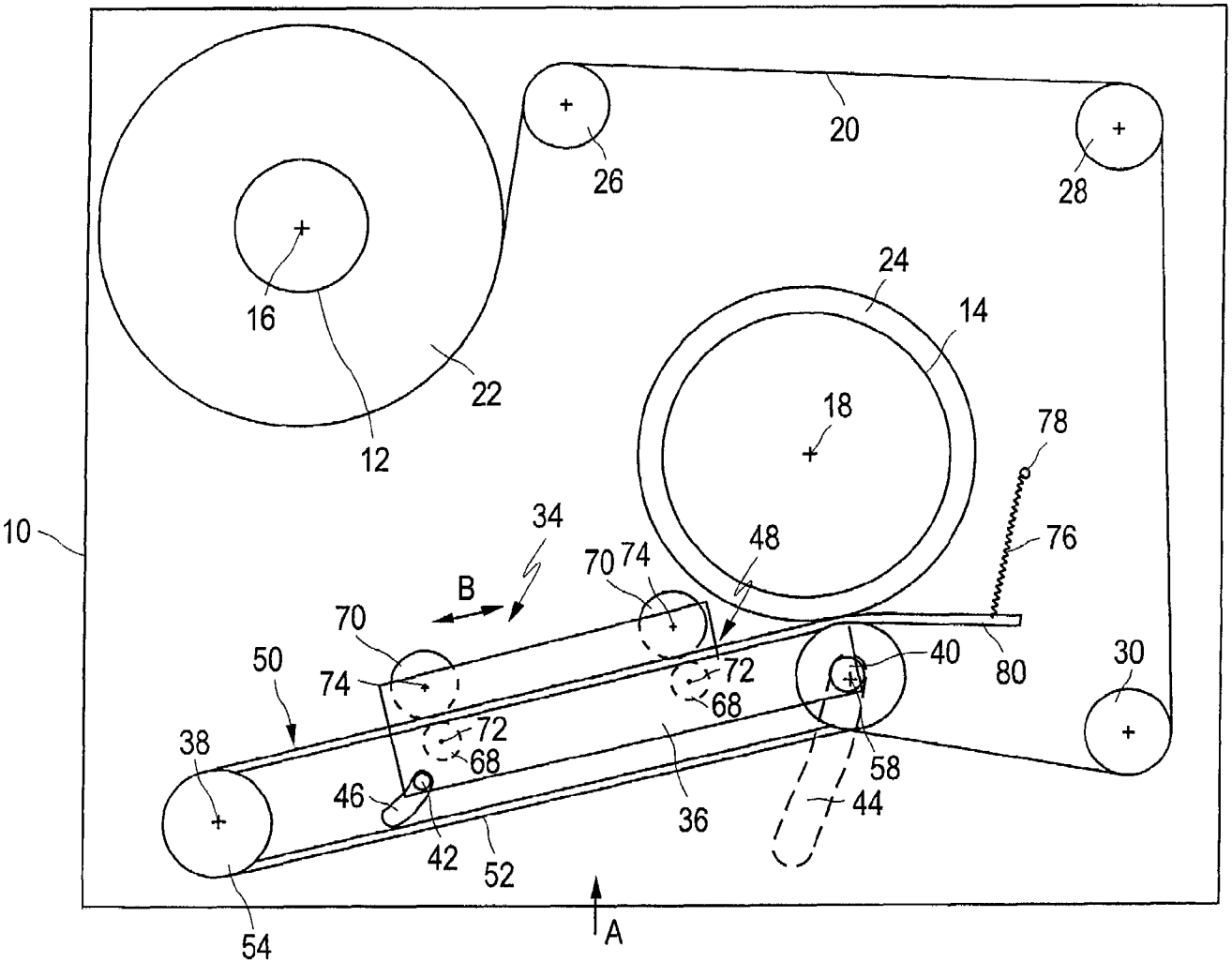
FIG. 1 shows a schematic side view of the roll storage system according to the invention in the direction of the axis of the storage roll, with a small diameter of the storage-roll coil.
Figure 2:
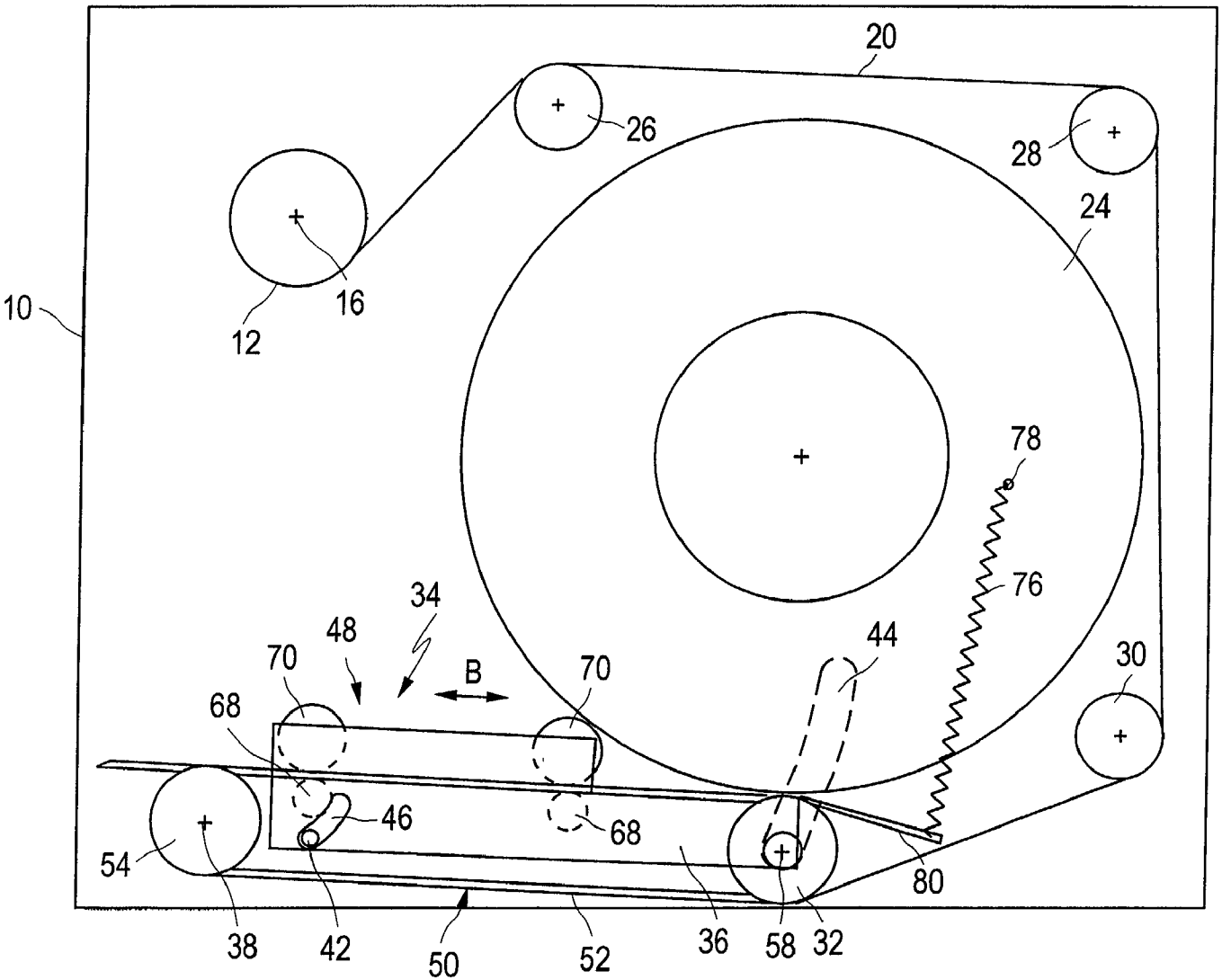
FIG. 2 shows a view corresponding to FIG. 1 with a maximum diameter of the storage-roll coil.
Figure 3:
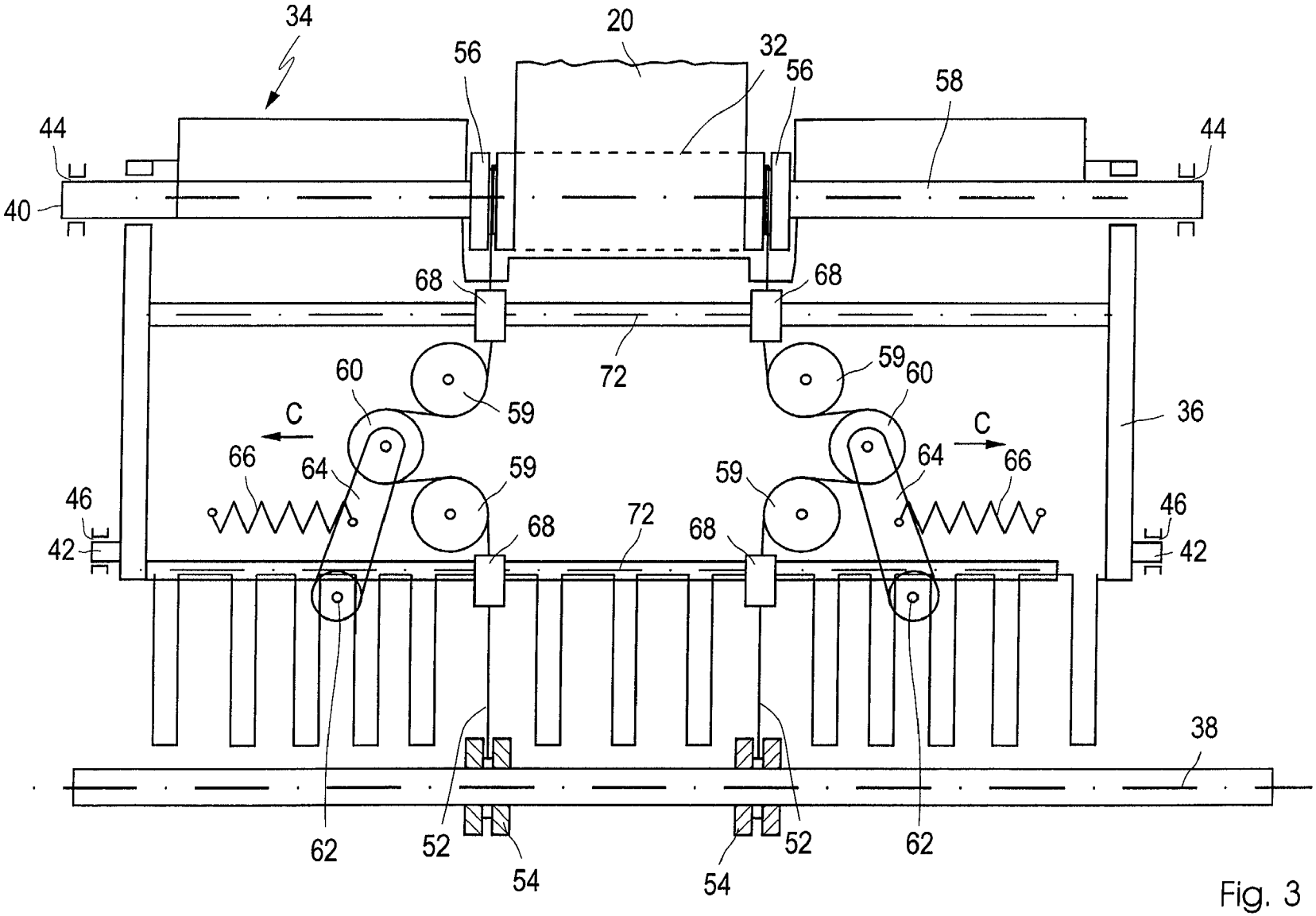
FIG. 3 shows a schematic view of the conveyor table from below, i.e. in the direction of the arrow A in FIG. 1.

The roll storage system illustrated in FIGS. 1 and 2 includes a housing 10, in which a supply roll 12 and a storage roll 14 are mounted such that they can rotate about pins 16 and 18 fixed to the housing. A storage film 20 is connected both to the supply roll 12 and to the storage roll 14 and can be wound between these two rolls, forming a supply coil 22 and a storage-roll coil 24, respectively. For this purpose, the rolls 12 and 14 are connected to suitable drive devices (not illustrated). The storage film is guided between the supply roll 12 and the storage roll 14 over stationary deflection rollers 26, 28, 30 and a movable deflection roller 32 (FIG. 3), which is mounted on a conveyor table (designated in general terms by 34), which is to be explained in more detail in the following text.

The conveyor table 34 has a frame 36 which, when the conveyor table 34 is adjusted between the positions illustrated in FIGS. 1 and 2, simultaneously executes a pivoting movement about a shaft 38 fixed to the housing and a translatory movement in the direction of the double arrow B, that is to say parallel to the conveying direction. For this purpose, the frame 36 has front and rear extensions 40, 42 which project laterally and engage in curved guide slots 44, 46 which are fixed in the housing, as is illustrated in FIGS. 1 and 2.

Furthermore, the conveyor table 34 comprises a transfer conveyor 48 for transferring banknotes to the storage-roll coil 24 and, respectively, for removing banknotes from the storage-roll coil 24. The transfer conveyor comprises a belt conveyor 50 having an endless belt 52. The latter is guided over two first rollers 54, mounted such that they can rotate at an axial distance from each other on the pivot shaft 38, and second rollers 56 which, together with the movable deflection roller 32, are mounted so that they can rotate on a shaft 58, which is held in the frame 36 of the conveyor table 34.

If the frame 36 of the conveyor table 34 is adjusted in the direction of the double arrow B, the distance between the shafts 38 and 58 changes. In order to keep the tension on the endless belt 52 constant during this change in the distance, in each case a tensioning device is provided, including two deflection rollers 59 and a tensioning roller 60, which is mounted on a pivoting lever 64 which is mounted such that it can pivot about a pivot pin 62 on the frame 36. The pivoting lever 64 is biased by a tension spring 66 in the direction of the arrow C in FIG. 3.

Pairs of rollers, which each include a supporting roller 68 supporting the endless belt and a back-pressure roller 70 in each case assigned to said supporting roller, interact with the top run of the endless belt 52, the rollers 68 and 70 being mounted on the frame 36 such that they can rotate about pins 72 and 74, respectively.

In the state of the roll storage system illustrated in FIG. 1, the storage film 20 has been wound completely onto the supply roll 12. The storage-roll coil 24 thus has its smallest diameter. In this position, the conveyor table 34, under the action of a tension spring 76, which acts on the one hand on a point 78 fixed to the housing and on the other hand on an extension 80 of the frame 36, assumes its uppermost position, in which the conveyor table 34 rests on the surface of the storage-roll coil 24. In this position, the shafts 38 and 58 of the belt conveyor 50 are at their greatest distance from each other.

FIG. 2 shows the roll storage system in a state in which the storage-roll coil 24 has its greatest diameter. As a result of the growing storage-roll coil 24, the conveyor table 34 resting on its surface is pressed downward counter to the force of the tension spring 76. During this downward pivoting movement, the frame 36 is displaced in the direction of the pivot shaft 38 as the result of the extensions 40 and 42 sliding in the slot guides 44, 46.

Since the belt conveyor 50, just like the shaft 58, is arranged on the frame 36 of the conveyor table 34, said belt conveyor follows the movement of the latter. This means that the distance of the gap, formed between the back-pressure rollers 70 and the supporting rollers 68, from the point at which the storage film 20 runs onto the storage-roll coil 24 always remains constant. As a result, irrespective of the diameter of the storage-roll coil 24, a favorable guidance is constantly maintained for the sheet-like objects as they run onto the storage-roll coil 24 or during the removal operation from the storage-roll coil 24. It is therefore possible to use a greater difference between the smallest coil diameter and the largest coil diameter of the storage-roll coil. Given the same overall size of the roll storage system as a whole, it is thus possible for the storage volume to be increased considerably.

Although modifications and changes may be suggested by those skilled in the art, it is the intention of the inventors to embody within the patent warranted hereon all changes and modifications as reasonably and properly come within the scope of their contribution to the art.

The invention claimed is:

1. A roll storage system for sheet-like objects, comprising:

a housing having a rotatable supply roll for a storage film and a rotatable storage roll receiving the storage film, the storage film storing the sheet-like objects;

the storage film being guided between the supply roll and the storage roll over at least one deflection roller;

a guide device which guides the sheet-like objects onto and away from the storage film so that they are guided into and out of a coil on the storage roll; and the guide device comprising a conveyor table which is pivotable about a pivot pin fixed to the housing and a length of the conveyor table being adjustable parallel to a conveying direction of the sheet-like objects such that in a first position with the storage roll with the coil having a first diameter the conveyor table has a first length and in a second position with the storage roll with the coil having a second different diameter the conveyor table has a second length different than the first length, the table comprising a transfer conveyor which guides the sheet-like objects into the coil on the storage roll and for removing the sheet-like objects from the coil on the storage roll.

2. The system of claim 1 wherein a transfer end of the conveyor table remote from the pivot pin is pretensioned so as to rest on the coil on the storage roll.

3. A roll storage system for sheet-like objects, comprising:

a housing having a rotatable supply roll for a storage film and a rotatable storage roll receiving the storage film, the storage film storing the sheet-like objects;

the storage film being guided between the supply roll and the storage roll over at least one deflection roller;

a guide device which guides the sheet-like objects onto and away from the storage film so that they are guided into and out of a coil on the storage roll;

the guide device comprising a conveyor table which is pivotable about a pivot pin fixed to the housing and a length of the conveyor table being adjustable parallel to a conveying direction of the sheet-like objects, the table comprising a transfer conveyor which guides the sheet-like objects into the coil on the storage roll and for removing the sheet-like objects from the coil on the storage roll; and the transfer conveyor comprises a belt conveyor having at least one endless belt, and supporting and back-pressure rollers interacting with the belt.

4. The system of claim 3 wherein the endless belt of the belt conveyor is guided over a first roller mounted coaxially with respect to the pivot pin of the conveyor table, and over a second roller mounted on the conveyor table.

5. The system of claim 4 wherein the endless belt is guided over a tensioning device.

6. The system of claim 4 wherein the second roller of the conveyor belt is arranged coaxially with respect to a deflection roller of the storage film and is fixed so that it rotates with the roller.

7. A roll storage system for sheet-like objects, comprising:

a housing having a rotatable supply roll for a storage film and a rotatable storage roll receiving the storage film, the storage film storing the sheet-like objects;

the storage film being guided between the supply roll and the storage roll over at least one deflection roller;

a guide device which guides the sheet-like objects onto and away from the storage film so that they are guided into and out of a coil on the storage roll;

the guide device comprising a conveyor table which is pivotable about a pivot pin fixed to the housing and a length of the conveyor table being adjustable parallel to a conveying direction of the sheet-like objects, the table comprising a transfer conveyor which guides the sheet-like objects into the coil on the storage roll and for removing the sheet-like objects from the coil on the storage roll; and the conveyor table is guided by at least one extension in a slot guide fixed to the housing such that during a pivoting movement of the conveyor table the at least one extension is forcibly displaced parallel to said conveying direction.

8. A roll storage system for sheet-like objects, comprising:

a rotatable supply roll for a storage film and a rotatable storage roll receiving the storage film, the storage film storing the sheet-like objects;

a guide device which guides the sheet-like objects onto and away from the storage film so that they are guided into and out of a coil on the storage roll; and the guide device comprising a conveyor table which is pivotable and a length of the conveyor table being adjustable parallel to a conveying direction of the sheet-like objects such that in a first position with the storage roll with the coil having a first diameter the conveyor table has a first length and in a second position with the storage roll with the coil having a second different diameter the conveyor table has a second length different than the first length, the table comprising a transfer conveyor which guides the sheet-like objects into the coil on the storage roll and for removing the sheet-like objects from the coil on the storage roll.

9. A roll storage system for sheet-like objects, comprising:

a housing having a rotatable supply roll for a storage film and a rotatable storage roll receiving the storage film, the storage film storing the sheet-like objects;

the storage film being guided onto the storage roll via a moveable deflection roller;

a guide device which guides the sheet-like objects onto and away from the storage film so that they are guided into and out of a coil on the storage roll; and the guide device comprising a conveyor table which is pivotable about a pivot axis at one end and a length of the conveyor table being adjustable parallel to a conveying direction of the sheet-like objects such that in a first position with the storage roll with the coil having a first diameter the conveyor table has a first length and in a second position with the storage roll with the coil having a second different diameter the conveyor table has a second length different than the first length, the table comprising a transfer conveyor which guides the sheet-like objects into the coil on the storage roll and for removing the sheet-like objects from the coil on the storage roll.

* * * * *